United States Patent [19]

Quarella

[11] 4,344,526

[45] Aug. 17, 1982

[54] TOBACCO STREAM BUILDING CHANNEL FOR USE IN CIGARETTE ROD MAKING MACHINES OR THE LIKE

[75] Inventor: Guido Quarella, Escheburg, Fed. Rep. of Germany

[73] Assignee: Hauni-Werke Körber & Co. KG, Hamburg, Fed. Rep. of Germany

[21] Appl. No.: 174,539

[22] Filed: Aug. 1, 1980

Related U.S. Application Data

[63] Continuation of Ser. No. 909,535, May 25, 1978, abandoned.

[30] Foreign Application Priority Data

Jun. 18, 1977 [DE] Fed. Rep. of Germany ..... 2727572

[51] Int. Cl.[3] ..... B65G 15/28

[52] U.S. Cl. ..... 198/689; 131/84 B; 131/110; 198/841

[58] Field of Search ..... 198/689, 811, 841; 131/84 B, 110

[56] References Cited

U.S. PATENT DOCUMENTS 3,127,854 4/1964 Reisman ..... 198/841 X 4,003,385 1/1977 Adebanr et al. ..... 131/84 B

*Primary Examiner*—Jeffrey V. Nase

*Attorney, Agent, or Firm*—Kontler, Grimes & Battersby

[57] ABSTRACT

A tobacco stream building channel wherein the bottom wall between two parallel side walls consists of groups of bars which are alternately inclined at an oblique angle in opposite directions with respect to the longitudinal direction of the channel. A suction chamber is disposed below and one stretch of an endless foraminous belt travels above the bottom wall. A distributor showers tobacco particles into the channel; such particles are attracted to the moving belt and form a growing stream which is thereupon converted into the filler of a cigarette rod. The aforementioned orientation of bars which constitute the bottom wall of the channel reduces or eliminates noise which is generated when the bars extend at right angles to the direction of movement of the belt.

7 Claims, 2 Drawing Figures

TOBACCO STREAM BUILDING CHANNEL FOR USE IN CIGARETTE ROD MAKING MACHINES OR THE LIKE

This is a continuation, of application Ser. No. 909,535, filed May 25, 1978, now abandoned.

BACKGROUND OF THE INVENTION

The present invention relates to machines for the making of cigarettes, cigars, cigarillos, filter rods or analogous rod-shaped articles which constitute or form part of smokers' products. More particularly, the invention relates to improvements in the construction of those parts of such machines wherein a shower of tobacco particles or the like is converted into a continuous stream. For the sake of simplicity, the invention will be described with reference to machines which are used for the production of cigarettes, it being understood, however, that the invention can be embodied with equal advantage in other types of machines wherein particulate material is showered into a channel to form a growing stream which is thereupon draped into a web of wrapping material to form a continuous rod.

A cigarette making machine comprises a so-called distributor which showers particles of shredded tobacco into an elongated channel wherein the particles are intercepted and entrained by one side of a foraminous belt the other side of which is adjacent to a suction chamber. The intercepted particles form a growing tobacco stream which is thereupon converted into a rod-like filler of constant cross-section, draped into a web of cigarette paper and subdivided into discrete cigarettes of desired length. As a rule, the suction chamber forms part of or includes or is adjacent to the elongated channel which has two parallel side walls and an air-permeable bottom wall between the side walls. The bottom wall is disposed between the belt and the suction chamber and enables air to flow through the pores or interstices of the moving belt and into the suction chamber so that the particles of tobacco which are showered to the one side of the belt adhere thereto regardless of whether the growing stream is formed at the upper side or at the underside of the belt. The bottom wall normally consists of ceramic bars which extend at right angles to the direction of movement of the belt. When the machine is in use, the currents of air which traverse the belt and the bottom wall on their way into the suction chamber generate noise which consists of whistling sounds and is highly unpleasant to the attendants. It is believed that the cause for generation of such noise is to be found in the orientation of bars which form the bottom wall of the channel, and in the orientation of filaments of which the belt consists. The majority of filaments extend at right angles to the direction of movement of the belt, i.e., they are parallel or nearly parallel to the bars of the bottom wall.

OBJECTS AND SUMMARY OF THE INVENTION

An object of the invention is to provide a cigarette making or like machine with a novel and improved tobacco stream building channel which is constructed and assembled in such a way that the formation of a continuous stream of discrete particles of tobacco or the like is not accompanied by the generation of noise.

Another object of the invention is to provide the tobacco stream building channel with a novel and improved bottom wall.

A further object of the invention is to provide a cigarette rod making machine which embodies the above outlined bottom wall.

An additional object of the invention is to provide a channel which can be used in conjunction with conventional tobacco transporting belts without the generation of whistling sounds which are characteristic of machines employing presently known tobacco channels.

An ancillary object of the invention is to provide a simple and inexpensive tobacco channel which can cooperate with the tobacco transporting belt in such a way that the generation of noise is nil or only a small fraction of noise which is typical of presently known machines for the making of cigarettes or the like.

The invention is embodied in a machine for producing a stream or tobacco or like particulate material. The machine comprises an elongated channel having two spaced-apart side walls and a foraminous third or bottom wall extending between the side walls, a suction chamber adjacent to one side of the third wall, an endless foraminous belt having a portion adjacent to the other side of the third wall, means for moving the belt lengthwise in a predetermined direction, and means for feeding particulate material into the channel whereby the material is attracted to and transported by the belt portion. In accordance with the invention, the third wall comprises alternating first and second portions which extend between the side walls and each of which includes at least one rod or bar made of ceramic or other suitable material. The rods or bars make oblique angles with the direction of movement of the belt, and the inclination of rods or bars of the first portions is opposite to the inclination of rods or bars of the second portions. Otherwise stated, the front ends of the rods or bars which constitute the first portions are nearer to one of the side walls, and the front ends of the rods or bars which constitute the second portions are nearer to the other side wall.

At least some portions of the third wall preferably consist of groups of several substantially parallel bars or rods.

It has been found that, when a conventional belt is caused to travel along the novel bottom wall, the whistling noise is reduced to a minimum or is not detectable at all.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
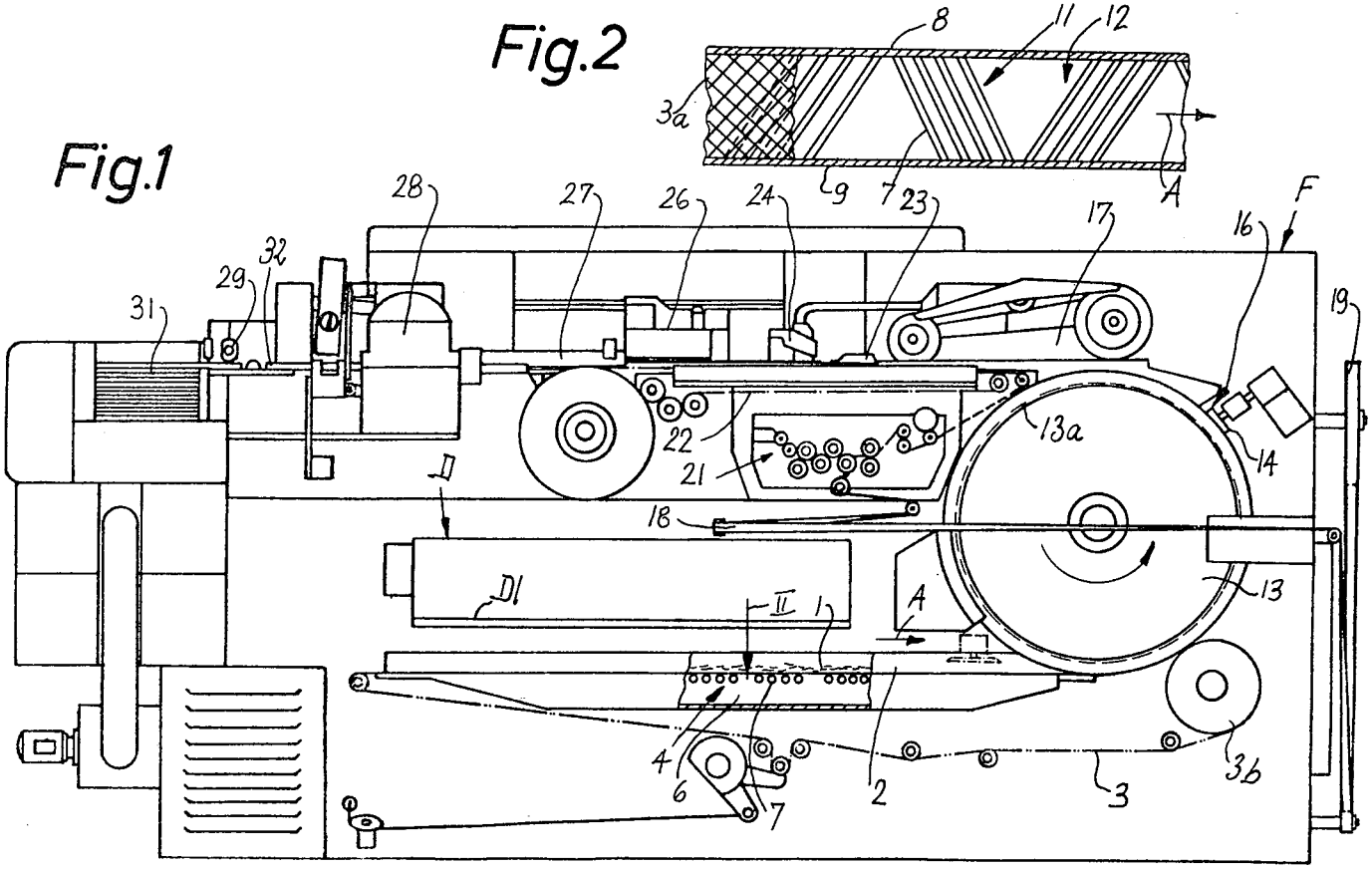
FIG. 1 is a somewhat schematic elevational view of a cigarette rod making machine which includes a tobacco stream building channel having a bottom wall which is constructed and assembled in accordance with the invention, a portion of the tobacco channel being broken away.
FIG. 2 is an enlarged plan view of a portion of the channel as seen in the direction of arrow II in FIG. 1, with the side walls shown in horizontal section.

FIG. 1 shows a cigarette rod making machine of the type known as GARANT produced by Hauni-Werke Körber & Co. KG., Hamburg, Federal Republic Germany. The machine comprises a frame or housing F which confines a distributor D, e.g., a distributor of the type disclosed in commonly owned U.S. Pat. No. 3,996,944 granted Dec. 14, 1976 to Alfred Hinzmann. The disclosure of this patent is incorporated herein by reference.

The relatively wide endless belt or apron D1 of the distributor D advances the leading edge of a wide sliver of tobacco particles in a direction toward the observer of FIG. 1 and showers the particles of the leading edge into an elongated tobacco channel 2 which, as shown in FIG. 2, has two spaced-apart elongated parallel upright side walls 8, 9 and a substantially horizontal air-permeable bottom wall or third wall 4 between the side walls 8 and 9. The channel 2 is mounted on or made integral with an elongated narrow suction chamber 6 which is adjacent to the underside of the bottom wall 4. The connection between the suction chamber 6 and a fan or another suitable suction generating device of the machine is not shown in the drawing.

The upper reach 3*a* of an elongated narrow foraminous tobacco transporting belt 3 overlies the upper side of the bottom wall 4 between the side walls 8 and 9. As indicated in FIG. 2, the belt 3 consists of filamentary material and includes filaments which can extend at right angles to and in the direction (arrow A) of lengthwise movement of the upper stretch 3*a*. The belt 3 is driven by a roller 3*b* which receives motion from the main prime mover, not shown.

The growing tobacco stream 1 which accumulates in the channel 2 below the apron D1 and adheres to the upper side of the upper reach 3*a* is transported in the direction of arrow A and is transferred into the endless circumferential groove 13*a* of a suction wheel 13. The bottom wall of the groove 13*a* is foraminous and surrounds a suction chamber (not shown) which causes the particles of the fully grown tobacco stream to adhere to the outer side of the bottom wall and to advance past a trimming or equalizing device 14 which removes the surplus so that the remaining particles of the stream form a continuous rod-like filler 16 which is ready for draping into a continuous web 18 of cigarette paper. The web 18 is drawn off a reel 19 and is caused to pass through an imprinting mechanism 21 which applies information denoting the brand name of cigarettes, the name or trademark of the manufacturer and/or others. The web 18 is thereupon caused to advance toward and to move with the upper stretch of an endless belt conveyor 22 known as garniture.

The rod-like filler 16 is transferred onto the web 18 on the garniture 22 by a transfer conveyor 17 which is an endless foraminous belt whose lower stretch travels below a suction chamber and causes the filler 16 to adhere thereto during transport from the apex of the suction wheel 13 to the right-hand end portion of the garniture 22. The latter forms part of a wrapping mechanism 23 wherein the web 18 is draped around the filler 16 in such a way that one of its marginal portions extends upwardly and is coated with adhesive by a paster 24. The mechanism 23 thereupon folds the adhesive-coated marginal portion over the other marginal portion of the draped web 18, and the resulting seam of the thus obtained continuous cigarette rod 27 is heated or cooled by a sealer 26 (depending upon the nature of the adhesive, i.e., whether the adhesive is a hotmelt or a glue which sets in response to heating). The rod 27 is severed at regular intervals by a cutoff 28 so that it yields a single file of discrete plain cigarettes 32 which are propelled into successive peripheral flutes of a rotary drum-shaped row forming conveyor 31 by an accelerating cam 29.

Save for the third or bottom wall 4 of the tobacco channel 2, the heretofore described parts of the cigarette rod making machine are of conventional design. The bottom wall 4 consists of elongated rod- or bar-shaped members 7 which are disposed in a common plane (in the embodiment of FIG. 1, the plane is substantially horizontal) and extend between the side walls 8 and 9. It can be said that the members 7 constitute a so-called bar grate wherein the bars do not intersect each other. In accordance with a feature of the invention, the bottom wall 4 consists of alternating first and second portions 11, 12 each of which includes several parallel members 7. The members 7 make an oblique angle with the direction which is indicated by the arrow A; furthermore, the members 7 of each portion 11 are inclined in one direction and the members 7 of each portion 12 are inclined in the opposite direction. The members 7 of the portions 11 can make an angle of approximately 90 degrees with the members 7 of the portions 12.

As shown in FIG. 2, the front ends of the members 7 which constitute the portions 11 are nearer to the side wall 9, and the front ends of the members 7 which constitute the portions 12 are nearer to the side wall 8.

FIG. 2 further shows that the number (four) of members 7 in each portion 11 is the same as the number of members 7 in each portion 12. However, it is equally within the purview of the invention to assemble the bottom wall 4 in such a way that the number of members 7 in each portion 11 is different from the number of members 7 in each portion 12, that the number of members 7 in the portions 11 or 12 is not the same, or that each portion consists of a single member 7. It has been found that the grouping of members in each of the portions 11 and 12 into sets of two or more members simplifies the construction of the bottom wall 4. Such members are assumed to consist of a suitable ceramic material.

Experiments with the improved bottom wall 4 prove that the whistling sounds which are characteristic of tobacco channels wherein the bars extend at right angles to the direction of movement of the foraminous tobacco belt are hardly audible or cannot be detected at all. This is attributed to the aforediscussed orientation of the members 7.

FIG. 1 shows that the members 7 are rods of circular cross-sectional outline. However, it is equally possible to employ rod- or bar-shaped members having a polygonal or oval cross-sectional outline, or a combination of different outlines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a machine for producing a stream of tobacco or other particulate material, the combination of an elongated channel having two spaced-apart side walls and an air-permeable third wall between said side walls, said third wall having a first and a second side; a suction chamber adjacent to one side of said third wall; an endless foraminous belt having a stretch adjacent to the other side of said third wall; means for moving said belt lengthwise in a predetermined direction, said belt having filaments extending substantially at right angles to said direction; and means for feeding particulate material into said channel whereby the material is attracted to and transported by said stretch in said direction, said third wall comprising alternating first and second portions extending between said side walls and each including at least one elongated substantially rod-shaped member, said members extending between said side walls and each making an oblique angle with said predetermined direction and with said filaments, the inclination of members of each first portion being opposite to the inclination of members of each second portion and each of said members having a front end and a rear end, as considered in said direction, the front and rear ends of each member of each first portion being respectively adjacent to one of said side walls and the opposite side wall, and the front and rear ends of each member of each second portion being respectively adjacent to said opposite side wall and said one side wall.

2. The combination of claim 1, wherein at least some portions of said third wall consist of groups of substantially parallel members.

3. The combination of claim 1, wherein all of said members are disposed in a common plane.

4. The combination of claim 1, wherein said third wall is substantially horizontal.

5. The combination of claim 4, wherein said other side is the upper side of said third wall.

6. The combination of claim 1, wherein said members consist of ceramic material.

7. The combination of claim 1, wherein the number of members in each of said first and second portions is the same.

* * * * *